US010533820B2

(12) United States Patent
McMillan

(10) Patent No.: US 10,533,820 B2
(45) Date of Patent: Jan. 14, 2020

(54) CONCENTRIC RIFLE BARREL ASSEMBLY

(71) Applicant: James Eric McMillan, Macon, GA (US)

(72) Inventor: James Eric McMillan, Macon, GA (US)

(73) Assignee: U.S. Arms Company LLC, Macon, GA (US)

( * ) Notice: Subject to any disclaimer, the term of this patent is extended or adjusted under 35 U.S.C. 154(b) by 0 days.

(21) Appl. No.: 16/215,288

(22) Filed: Dec. 10, 2018

(65) Prior Publication Data

US 2019/0178598 A1 Jun. 13, 2019

Related U.S. Application Data

(60) Provisional application No. 62/596,472, filed on Dec. 8, 2017.

(51) Int. Cl.
*F41A 21/10* (2006.01)
*F41A 21/48* (2006.01)

(52) U.S. Cl.
CPC ..... *F41A 21/48* (2013.01); *F41A 21/10* (2013.01); *F41A 21/482* (2013.01)

(58) Field of Classification Search
CPC ..... F41A 21/00; F41A 21/04; F41A 21/10; F41A 21/12; F41A 21/44; F41A 21/48
USPC ..... 42/76.01, 77, 78
See application file for complete search history.

(56) References Cited

U.S. PATENT DOCUMENTS 72,063 A * 12/1867 McCulloch ..... F41C 9/08 42/51
213,616 A * 3/1879 Bowles ..... F41A 21/10 42/77
237,357 A * 2/1881 Zundorff ..... F41A 15/14 42/16
282,194 A * 7/1883 Howe ..... F41A 21/10 42/77
307,706 A * 11/1884 Brown ..... F41A 21/10 42/77
351,333 A * 10/1886 Morris ..... F41A 21/10 89/29
353,231 A * 11/1886 Morris ..... F41A 21/10 89/29
380,975 A * 4/1888 Bean ..... F41A 21/16 42/76.01

(Continued)

*Primary Examiner* — Derrick R Morgan
(74) *Attorney, Agent, or Firm* — Jason T. Daniel, Esq.; Daniel Law Offices, P.A.

(57) ABSTRACT

A concentric rifle barrel assembly includes an outer sleeve having a plurality of threads along the first and second ends, an elongated rifle barrel, and a locking nut. The first end of the rifle barrel is removably positioned within the sleeve and includes a chamber that is sized to receive a firearm cartridge. Threads on the locking nut engage the second end of the sleeve, and a positioning ring that is located a first distance from the first end of the rifle barrel. The first distance being complementary to the length of the sleeve minus the length of the rim of the firearm cartridge for which the barrel is designed to accommodate. Fluting is provided along one or both of the rifle barrel and the sleeve, and the sleeve is designed to receive any number of different rifle barrels each sized to accommodate cartridges of different sizes and calibers.

16 Claims, 7 Drawing Sheets

(56) References Cited

U.S. PATENT DOCUMENTS 640,070 A * 12/1899 Aeschbacher ..... F41A 21/10 42/77
834,341 A * 10/1906 Tucker ..... F42B 8/10 102/446
1,092,763 A * 4/1914 Bourdelles ..... F41A 21/02 42/77
1,126,294 A * 1/1915 Saffold ..... F41A 21/10 42/77
1,217,162 A * 2/1917 Egbers ..... F41A 21/10 42/77
1,344,991 A * 6/1920 Cunningham ..... F41A 3/26 42/16
1,355,422 A * 10/1920 Pedersen ..... F41A 21/12 42/76.01
1,428,081 A * 9/1922 Fuchs ..... F41A 21/482 42/106
1,517,328 A * 12/1924 Weiss ..... F41A 21/10 42/77
1,563,285 A * 11/1925 Netsch ..... F41A 5/20 42/69.02
1,759,772 A * 5/1930 Williams ..... F41A 21/10 42/77
1,825,190 A * 9/1931 Lefever ..... F41A 9/72 124/52
1,980,399 A * 11/1934 Green ..... F41A 13/12 89/14.1
2,112,144 A * 3/1938 Coupland ..... F41A 13/12 42/76.02
2,238,587 A * 4/1941 Gaidos ..... F41A 19/13 42/59
2,293,957 A * 8/1942 Wells ..... F41B 11/51 124/44.6
2,337,840 A * 12/1943 Scott-Paine ..... F41A 13/12 89/14.1
2,426,972 A * 9/1947 Magos ..... F41A 21/04 29/256
2,433,000 A * 12/1947 Manning ..... B29C 67/00 156/167
2,516,926 A * 8/1950 Simpson ..... F41A 5/24 42/76.01
2,621,024 A * 12/1952 Koppl ..... E21B 31/107 175/232
2,665,421 A * 1/1954 Temple ..... B25C 1/12 227/9
2,818,056 A * 12/1957 Martin ..... F41B 11/62 124/37
2,833,266 A * 5/1958 Mares ..... F41B 11/83 124/74
2,850,828 A * 9/1958 Sullivan ..... F41A 21/04 42/76.02
2,898,693 A * 8/1959 Ruger ..... F41A 11/02 42/76.02
2,910,701 A * 11/1959 Temple ..... B25C 1/123 227/8
2,918,674 A * 12/1959 Skumawitz ..... B25C 1/12 227/8
2,935,912 A * 5/1960 Hartley ..... F41A 13/12 42/76.02
2,956,481 A * 10/1960 Barr ..... F41A 19/03 89/129.01
2,957,176 A * 10/1960 Henning ..... B25C 1/105 227/8
2,972,800 A * 2/1961 Sterba ..... F41A 21/02 42/76.01
2,976,638 A * 3/1961 Owens ..... F41A 21/10 42/59
2,977,598 A * 4/1961 Broughton ..... B25C 1/105 227/8
2,984,925 A * 5/1961 Mendoza ..... F41C 3/00 124/2
3,027,672 A * 4/1962 Sullivan ..... F41A 21/12 42/16
3,261,264 A * 7/1966 Wilson ..... F41A 3/62 89/180
3,384,989 A * 5/1968 Thurman ..... F41A 21/10 42/77
3,440,924 A * 4/1969 Robinson ..... F41A 21/26 42/79
3,442,172 A * 5/1969 Lorenz ..... F41A 21/04 42/76.01
3,611,611 A * 10/1971 Quinney ..... F41A 21/482 42/75.02
3,708,841 A * 1/1973 Quinney ..... F41A 11/02 124/84
3,724,326 A * 4/1973 Day ..... F41A 11/02 42/49.02
3,727,513 A * 4/1973 Wicks ..... F41A 13/12 89/14.05
3,748,957 A * 7/1973 Arnold ..... F41A 21/00 42/76.01
3,793,922 A * 2/1974 Angell ..... F41A 3/36 42/76.01
3,837,107 A * 9/1974 Swaim ..... F42B 29/00 102/703
3,951,126 A * 4/1976 Rau ..... F41A 25/24 124/67
4,002,156 A * 1/1977 Fischer ..... F41B 11/51 124/67
4,019,423 A * 4/1977 Johnson ..... F41A 3/62 89/14.5
4,028,994 A * 6/1977 Ferluga ..... F41A 3/62 42/10
4,211,146 A * 7/1980 Bradley ..... F41A 21/02 89/16
4,304,061 A * 12/1981 Brouthers ..... F41A 21/488 42/59
4,455,777 A * 6/1984 Callies ..... F41C 7/12 42/59
4,459,774 A * 7/1984 Ferretti ..... F41A 21/10 42/77
4,501,189 A * 2/1985 Brandl ..... F41A 21/38 181/223
4,646,830 A * 3/1987 Templeton ..... E21B 31/107 166/178
4,735,009 A * 4/1988 Jett, Jr. ..... F41A 21/10 102/446
4,833,808 A * 5/1989 Strahan ..... F41A 21/28 42/1.06
4,833,810 A * 5/1989 Domian ..... F41A 11/02 42/137
5,125,320 A * 6/1992 Zielinski ..... F41A 1/04 89/7
5,445,325 A * 8/1995 White ..... B05B 7/201 239/13
5,520,334 A * 5/1996 White ..... B05B 7/201 239/135
5,654,519 A * 8/1997 Albrecht ..... F41A 25/22 89/163
5,692,334 A * 12/1997 Christensen ..... F41A 21/02 42/76.02
5,729,927 A * 3/1998 Shaver, Jr. ..... F42B 8/10 42/77
5,837,921 A * 11/1998 Rinaldi ..... F41A 13/12 89/14.1
5,983,772 A * 11/1999 Reynolds ..... F41A 21/10 42/77
6,178,769 B1 * 1/2001 Bartolles ..... F41A 13/04 62/404
6,196,108 B1 * 3/2001 Murello ..... F41A 25/10 89/198
6,513,274 B1 * 2/2003 Vastag ..... F41A 11/02 42/135
6,769,209 B2 * 8/2004 Mendoza-Orozco ..... F41A 21/10 42/77
6,889,464 B2 * 5/2005 Degerness ..... F41A 21/02 42/76.01

(56) References Cited

U.S. PATENT DOCUMENTS 7,013,592 B2 * 3/2006 Olson ..... F41A 21/24 42/76.01
7,076,904 B1 * 7/2006 Rustick ..... F41A 21/482 42/75.01
7,316,093 B2 * 1/2008 Kightlinger ..... F42B 5/025 102/430
7,562,478 B1 * 7/2009 Vastag ..... F41A 21/10 42/51
7,707,763 B2 * 5/2010 Brixius ..... F41A 13/06 42/76.01
7,987,624 B1 * 8/2011 Moller ..... F41A 19/69 42/106
8,453,634 B2 * 6/2013 Chen ..... F41A 21/32 124/83
8,701,326 B2 * 4/2014 Zonshine ..... F41A 21/10 42/77
8,746,126 B2 * 6/2014 Zheng ..... F41A 5/20 89/191.02
9,464,866 B1 * 10/2016 Liang ..... F41C 23/16
9,921,022 B1 * 3/2018 Noyce Merino ..... F41A 21/36
2005/0028421 A1 * 2/2005 Saxby ..... F41A 21/10 42/77
2006/0064914 A1 * 3/2006 Greer ..... F41A 11/02 42/77
2007/0012170 A1 * 1/2007 Spielberger ..... F41A 5/12 89/196
2011/0265365 A1 * 11/2011 Alonso Tricio ..... F41A 21/02 42/78
2012/0272941 A1 * 11/2012 Hu ..... F41A 21/12 124/83
2015/0376996 A1 * 12/2015 Downing ..... F04B 47/02 417/514
2016/0010938 A1 * 1/2016 Merkley ..... F41A 21/482 42/75.02
2016/0109204 A1 * 4/2016 Leone ..... F41A 21/18 42/76.1
2017/0059270 A1 * 3/2017 Pendleton ..... F41C 9/00
2017/0299291 A1 * 10/2017 Spector ..... F41G 11/003
2018/0080733 A1 * 3/2018 Battaglia ..... F41A 11/02
2019/0011217 A1 * 1/2019 Liao ..... F41B 11/89

* cited by examiner

CONCENTRIC RIFLE BARREL ASSEMBLY

CROSS-REFERENCE TO RELATED APPLICATIONS

This application claims the benefit of U.S. Application Ser. No. 62/596,472 filed on Dec. 8, 2017, the contents of which are incorporated herein by reference.

TECHNICAL FIELD

The present invention relates generally to firearms, and more particularly to a removable barrel assembly for a rifle.

BACKGROUND

The statements in this section merely provide background information related to the present disclosure and may not constitute prior art.

Many firearm owners routinely modify their weapons to suit a particular interest or a desired look. With particular regard to rifles, it can be desirable to change the barrel configuration depending on the conditions under which the firearm is to be used. For example, short, lightweight barrels are desirable for use with automatic or semi-automatic rifles in close quarters combat situations, whereas longer, heavier barrels are desirable for use with bolt action rifles shooting long range targets.

For this reason, there is no shortage of available after-market rifle barrels which can be mated to existing firearms so as to adapt the weapon for use as described above. With particular regard to bolt action rifles, one of the most common types of rifle barrels is a heavy contour barrel, often weighing over five pounds. Such barrels are preferred owing to their rigid construction which reduces vibration/harmonics when the weapon is fired. Unfortunately, the high weight of these barrels makes this option less attractive for the elderly or those with physical limitations.

Additionally, as traditional rifle barrels are repeatedly connected and disconnected from a receiver, the neck of the barrel becomes worn thus reducing the head spacing of the barrel over time and reducing the ability of the rifle to fire. Moreover, the process of removing and installing a barrel from/to the receiver is difficult and time consuming.

Finally, each of these barrels are specifically designed to be used with the same caliber cartridge as the barrel it is replacing. As such, there does not currently exist a fast, easy way to change the rifle barrel caliber without significant modifications to the weapon, and.

Accordingly, it would be beneficial to provide a concentric rifle barrel assembly that offers the same benefits of a heavy-contour barrel with a greatly reduced weight. It would also be beneficial to provide a barrel assembly having a rifle barrel that can be replaced so as to allow the weapon to fire cartridges of varying calibers and that connects in a manner that does not reduce headspace over time, so as to alleviate the drawbacks described above.

SUMMARY OF THE INVENTION

The present invention is directed to a concentric rifle barrel assembly. One embodiment of the present invention can include an outer sleeve having an elongated cylindrical-shape. A plurality of threads can be disposed along the first end of the sleeve for engaging complementary threads on a firearm receiver. The invention can also include an elongated rifle barrel having a first end and a second end. The first end of the rifle barrel can be removably positioned within the sleeve and can include a chamber that is sized to receive a firearm cartridge. A locking nut is provided and includes a threaded first end for engaging complementary threads on the second end of the sleeve for securing the barrel to the sleeve.

In one embodiment, a positioning ring is located a first distance from the first end of the rifle barrel. The first distance being complementary to the length of the sleeve minus the length of the rim of the firearm cartridge for which the barrel is designed to accommodate.

In one embodiment, the rifle barrel includes fluting for providing reduced weight and heat dissipation. In one embodiment, the sleeve includes fluting for also providing reduced weight and heat dissipation. The sleeve being configured to receive any number of different rifle barrels each sized to accommodate cartridges of different sizes and calibers.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
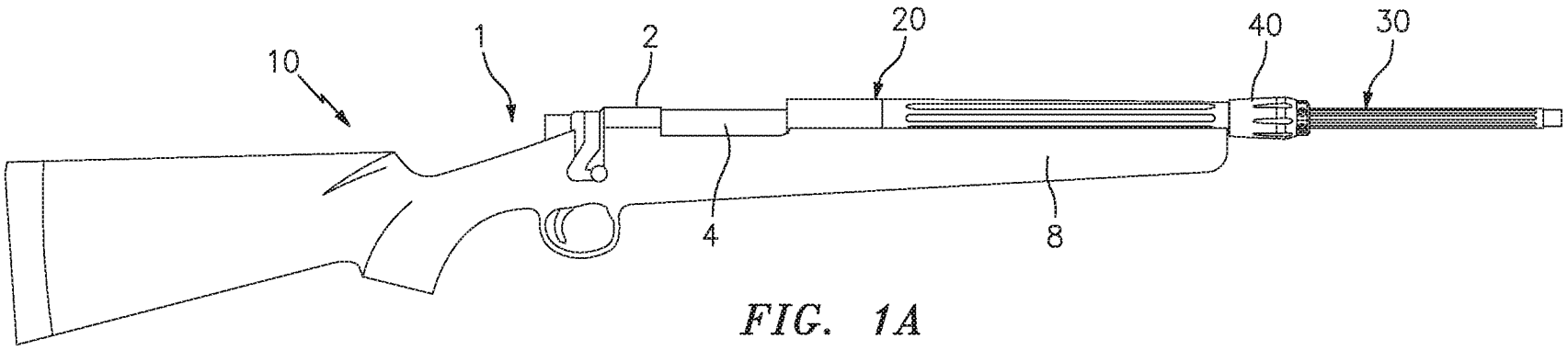
FIG. 1A is a side view of a rifle with the barrel assembly that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "about" when used in connection with a referenced numeric indication means the referenced numeric indication plus or minus up to 10 percent of that referenced numeric indication. For example, "about 100" means from 90 to 110.

As described herein, the term "removably secured," and derivatives thereof shall be used to describe a situation wherein two or more objects are joined together in a non-permanent manner so as to allow the same objects to be repeatedly joined and separated.

FIGS. 1A-5D illustrate one embodiment of a concentric rifle barrel assembly 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1A.

Figure 1B:
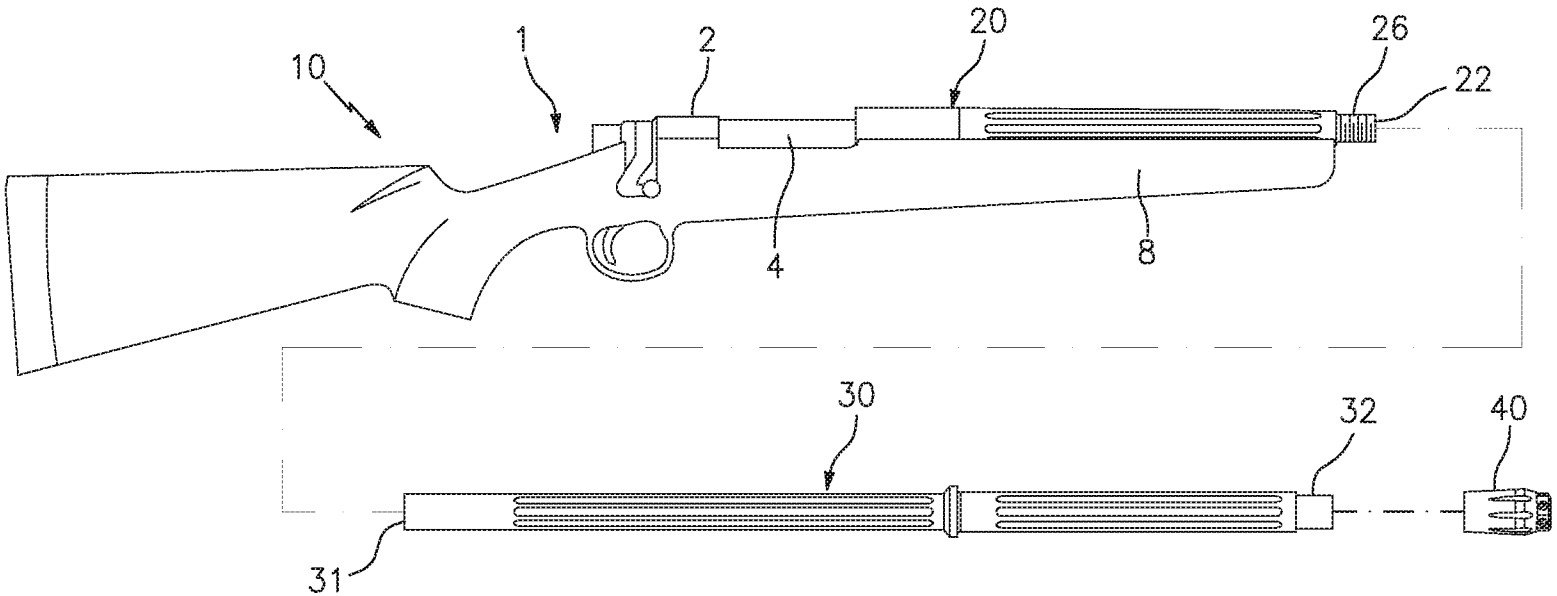
FIG. 1B is a side view of the rifle of claim 1, with a partially assembled barrel assembly, in accordance with one embodiment of the invention.
Figure 1C:
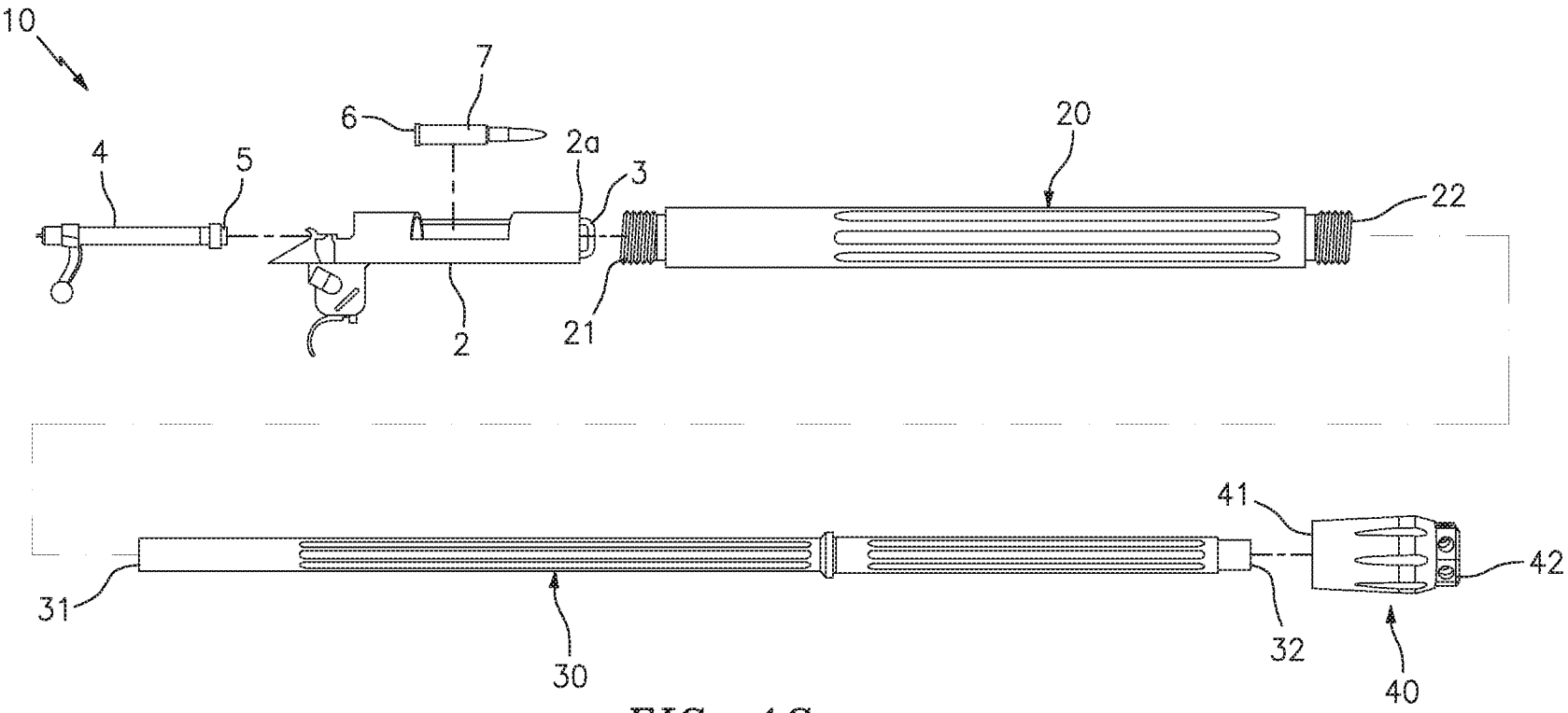
FIG. 1C is an exploded parts view of the rifle barrel assembly, in accordance with one embodiment of the invention.

FIGS. 1A-1C illustrate one embodiment of a concentric rifle barrel assembly 10 that includes, essentially, an outer sleeve 20, a removable barrel 30 and a barrel nut 40, that are designed to be mated with a rifle 1.

As will be known to those of skill in the art, a rifle 1 includes a receiver 2 having a distal end 2*a* containing a plurality of threaded elements 3 for engaging the complementary threaded elements 23 of a rifle barrel via a twisting motion. A rifle bolt 4 is removably positioned within the receiver and includes a bolt face 5 that is sized to engage the rim 6 of a firearm cartridge 7. It is noted that several rifle components are omitted from the illustrations for the sake of clarity; however, these components and the operation of rifles are notoriously well known in the art and need not be repeated herein.

Although shown with a REMINGTON MODEL 700 bolt action rifle, this is for illustrative purposes only. To this end, those of skill in the art will recognize that the inventive concepts disclosed herein are equally applicable for use with any number of other types of bolt action rifles, automatic rifles and/or semi-automatic rifles, without undue experimentation. It is also contemplated that the inventive concepts could be applied to other types of firearms such as heavy artillery, shotguns, pistols, etc., and/or can be incorporated into the design of a new brand new firearm.

Figure 2A:
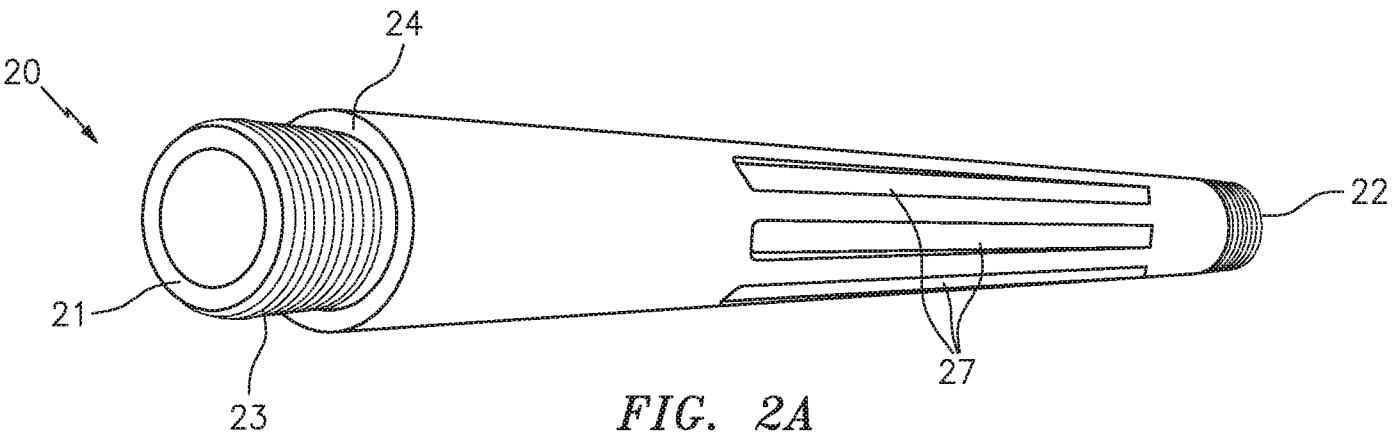
FIG. 2A is a perspective view of the outer sleeve of the barrel assembly, in accordance with one embodiment of the invention.

The outer sleeve 20 can function to receive and align the removable rifle barrel 30 with the firearm receiver. As shown at FIG. 2A, one embodiment of the outer sleeve 20 can include an elongated cylindrical-shaped member having a first end 21, a second end 22, and a smooth hollow interior surface extending between the two ends. In one embodiment, the first end of the outer sleeve can include a plurality of threads 23 that correspond to the threaded portion 3 of a firearm receiver 2. These threads secure the sleeve to the receiver via a twisting motion until the raised neck 24 is in contact with the distal end 2*a* of the receiver.

Figure 2B:
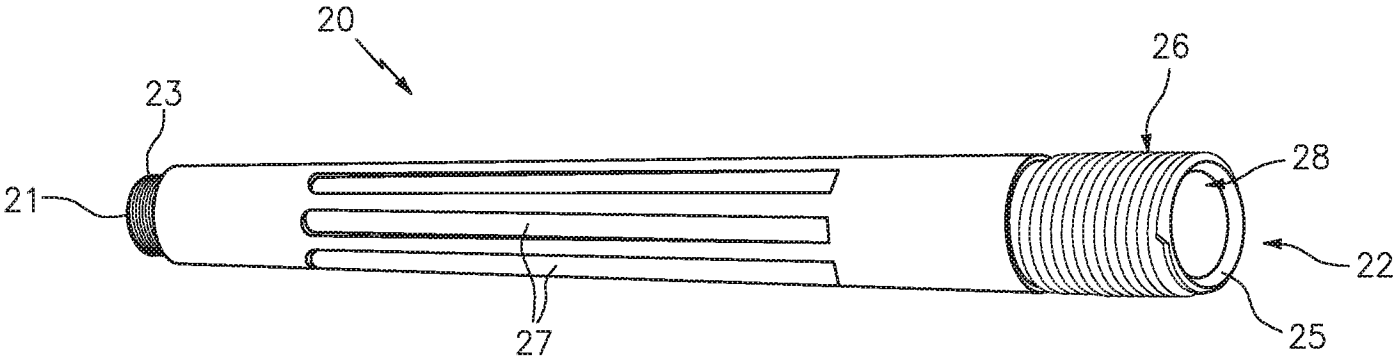
FIG. 2B is another perspective view of the outer sleeve of the barrel assembly, in accordance with one embodiment of the invention.

As shown best in FIG. 2B, the second end of the outer sleeve 22 can include a chamfered inner edge/shoulder 25, and another plurality of threads 26 along the outside surface, and an optional protrusion 28. As will be described below, the chamfered edge can be engaged by the positioning ring 34 of the rifle barrel, and the threads 26 can be engaged by the locking nut 40 to secure the rifle barrel 30 to the sleeve 20.

In one embodiment, the outside surface of the sleeve may include a plurality of elongated flutes 27 which may be arranged at any number of different orientations such as parallel or helical, for example, and may be provided along an entirety of the outer sleeve or a portion thereof. In either instance, the sleeve 20 may be constructed from any number of different materials such as titanium, steel, or stainless steel, for example, and can include varying lengths so as to be complementary to the length of the hand guard 8 of the rifle 1.

Figure 3A:
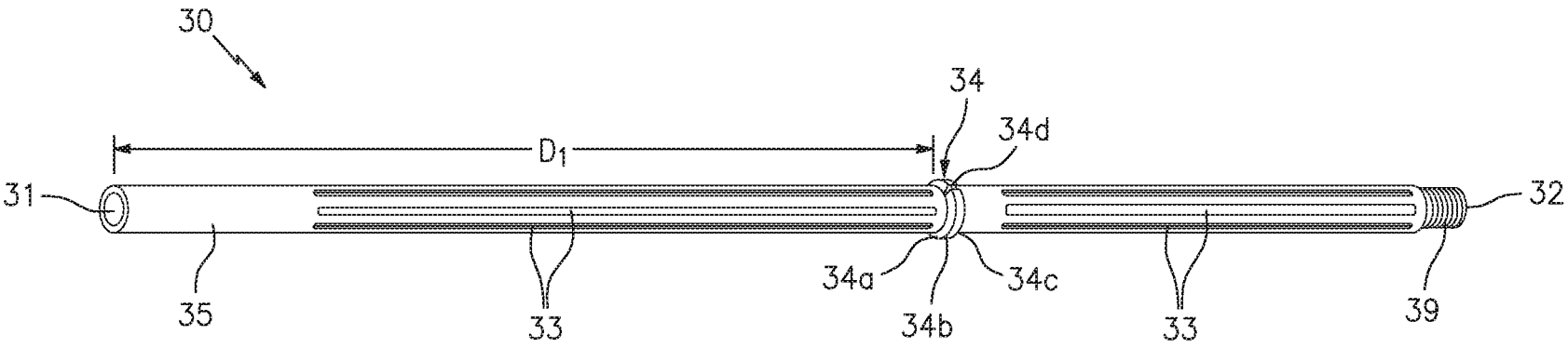
FIG. 3A is a perspective view of the rifle barrel of the barrel assembly, in accordance with one embodiment of the invention.
Figure 3B:
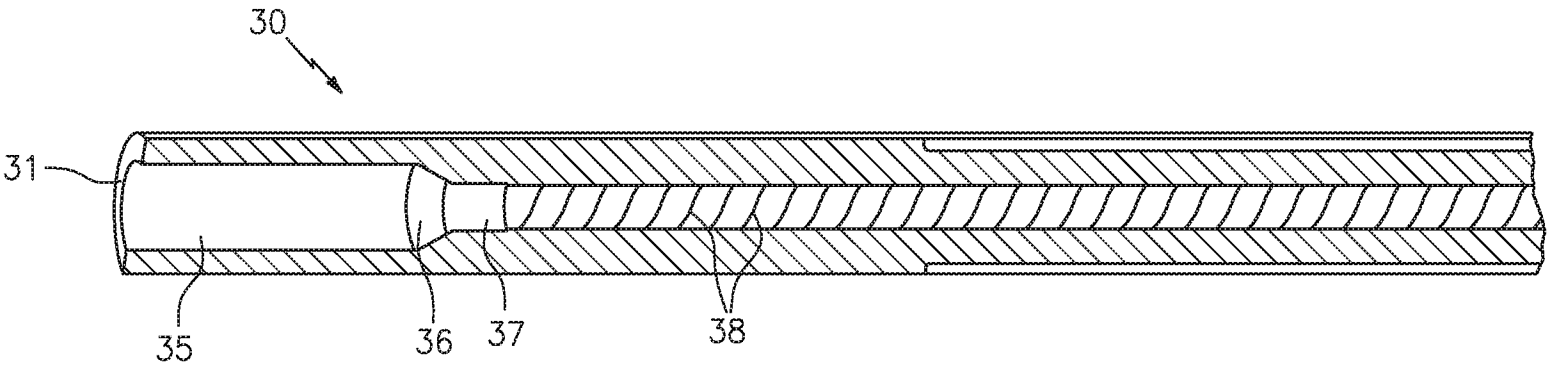
FIG. 3B is a cross sectional cutout view of the rifle barrel of the barrel assembly, in accordance with one embodiment of the invention.

FIGS. 3A and 3B illustrate one embodiment of the removable rifle barrel 30 for use with the above described sleeve 20. As shown, the barrel 30 can include an elongated hollow cylindrical-shaped member having a flat non-threaded first end 31, a muzzle 32, and a hollow interior surface extending between the two ends. Optional threads 39 may be positioned along the muzzle for allowing any number of secondary objects such as a muzzle brake, for example to be used with the assembly. In either instance, the rifle barrel may be constructed from any number of different metals suitable for firearms, such as titanium, steel or stainless steel, for example, and a portion of the rifle barrel will include an outside diameter that is complementary to the inside diameter of the outer sleeve 20.

In the preferred embodiment, the barrel 30 can also include fluting 33 along the outside surface. In this regard, the grooves which form the fluting 27 and 33 of the sleeve 20 and rifle barrel 30, respectively, provide several advantages over traditional one-piece heavy rifle barrels, as they function to reduce the overall weight of the barrel assembly 10 between 5% and 30% compared to a solid barrel of about the same dimensions, while also providing a larger surface area that dissipates heat faster than a non-fluted surface.

A positioning ring 34 can be positioned along the outside surface of the rifle barrel 30 and can function to ensure uniform alignment of the rifle barrel within the outer sleeve 20. In the preferred embodiment, the positioning ring 34 can be positioned at a distance D1 from the first end 31 that is complementary to the length (e.g., distance between first and second ends 21 and 22) of the outer sleeve 20 minus the length of the rim of the cartridge to be fired.

The positioning ring 34 can include a first edge 34*a* having an optional notch 34*d*. The first edge 34*a* can include an angle that matches the angle of the chamfered edge 25 located on the second end of the outer sleeve 20. The positioning ring can also include a middle portion 34*b* having a diameter that is complementary to the minor diameter of the threads 26 of the outer sleeve 20, and a second edge 34*c* having an angle that is complementary to the angled shoulder 43 of the below described locking nut 40. In the preferred embodiment, the angle of the edges 34*a* and 34*c* will be about 45 degrees, for ease of manufacturing; however other embodiments are contemplated where the angles of one or both edges are different.

As shown best in cutout FIG. 3B, a chamber 35 is formed within the central bore of the rifle barrel adjacent to the first end 31. The chamber is the high-pressure area into which the firearm cartridge is positioned when fired from the assembled weapon. As such, the chamber includes a smooth inner surface having a length and inside diameter that is complementary to the length and outside diameter of the cartridge to be fired. As shown, the chamber 35 is in communication with the barrel neck 36 and throat 37, at which time rifling 38 along the bore begins.

As noted above, the chamber 35 is designed to include a complementary shape and dimension as the cartridge to be fired. For example, when the barrel assembly 10 is mated with the above described model 700 rifle to fire a .223 cartridge, the chamber 35 of the rifle barrel 30 can include a diameter of about 9.6 mm and a length of about 45 mm. Likewise, when the rifle barrel 30 is constructed to fire a .308 cartridge the chamber will include a diameter of about 12 mm and a length of about 51 mm, for example. In both instances, the outer diameter of the rifle barrel 30 will remain the same and will be complementary to the inside diameter of a single sleeve 20. Such a feature ensures that one sleeve 20 can work with multiple rifle barrels 30 having that are constructed to receive and fire cartridges of any size and caliber.

Figure 4A:
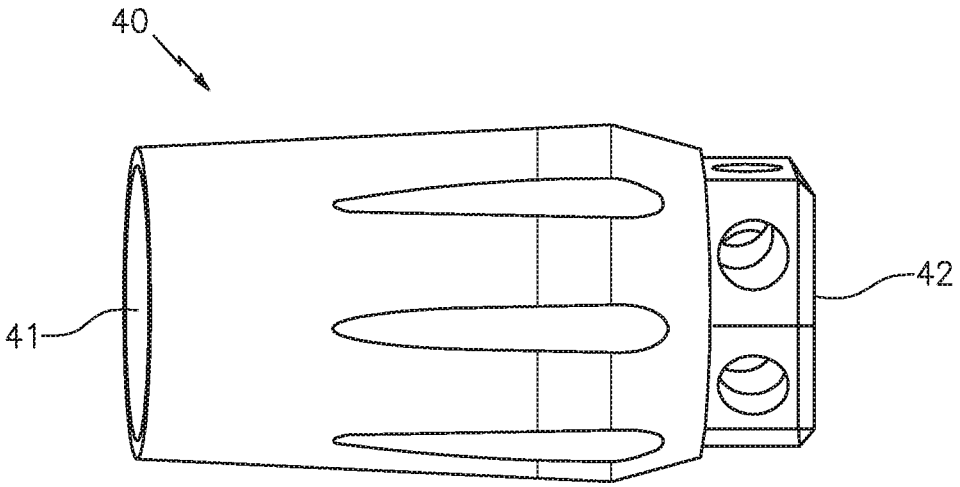
FIG. 4A is a side view of the locking ring of the barrel assembly, in accordance with one embodiment of the invention.
Figure 4B:
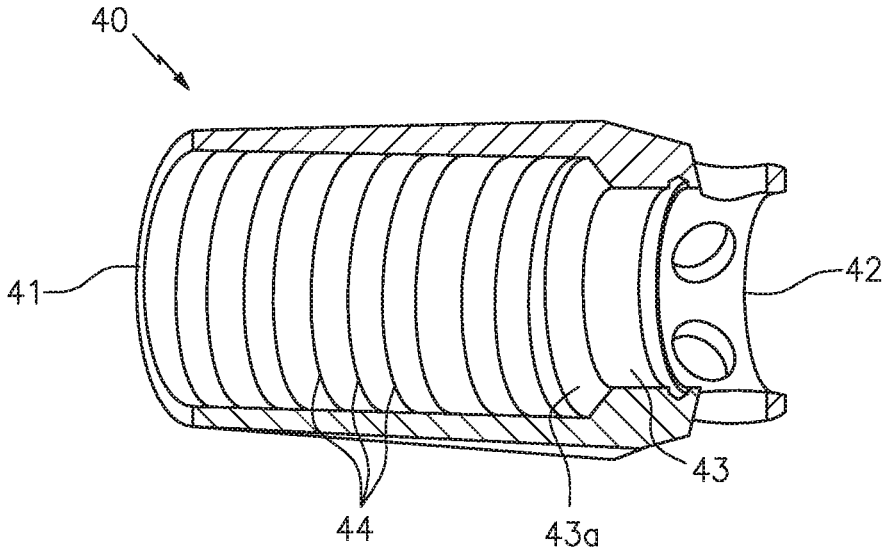
FIG. 4B is a cross sectional cutout view of the locking ring of the barrel assembly, in accordance with one embodiment of the invention.

FIGS. 4A and 4B illustrate one embodiment of the locking nut 40 for securing the rifle barrel 30 concentrically within the outer sleeve 20. As shown the locking nut 40 can include a first end 41 having a plurality of internal threads 44, a second end 42, an inner shoulder 43, and a hollow interior surface extending between the two ends. The locking nut 40 includes an inside dimension that is complementary to the outside dimension of the sleeve 20, and the shoulder 43 includes an angled edge 43*a* that is complementary to the second edge 34*c* of the positioning ring 34.

Figure 5A:
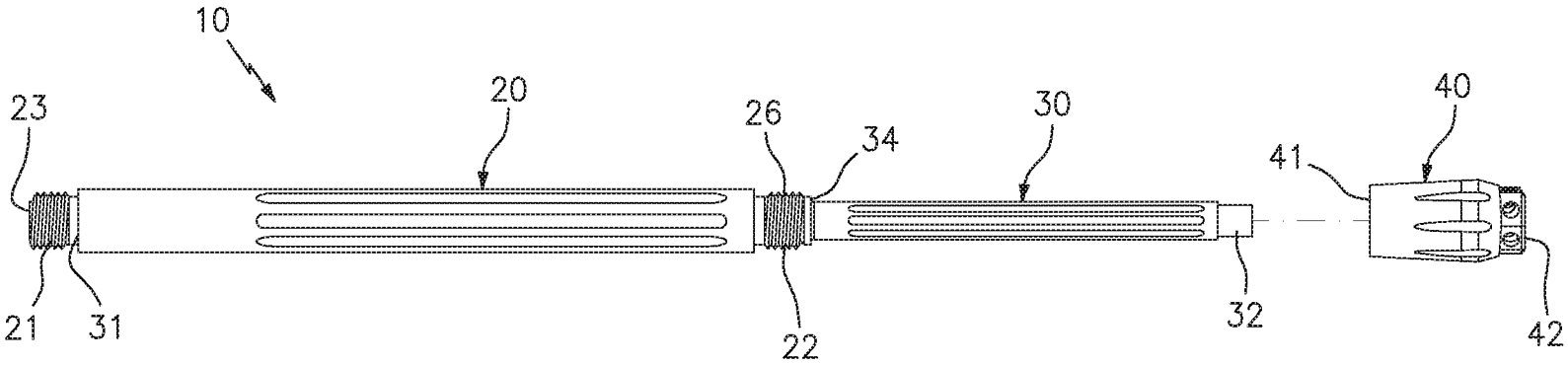
FIG. 5A is a side view of a partially assembled barrel assembly, in accordance with one embodiment of the invention.
Figure 5B:
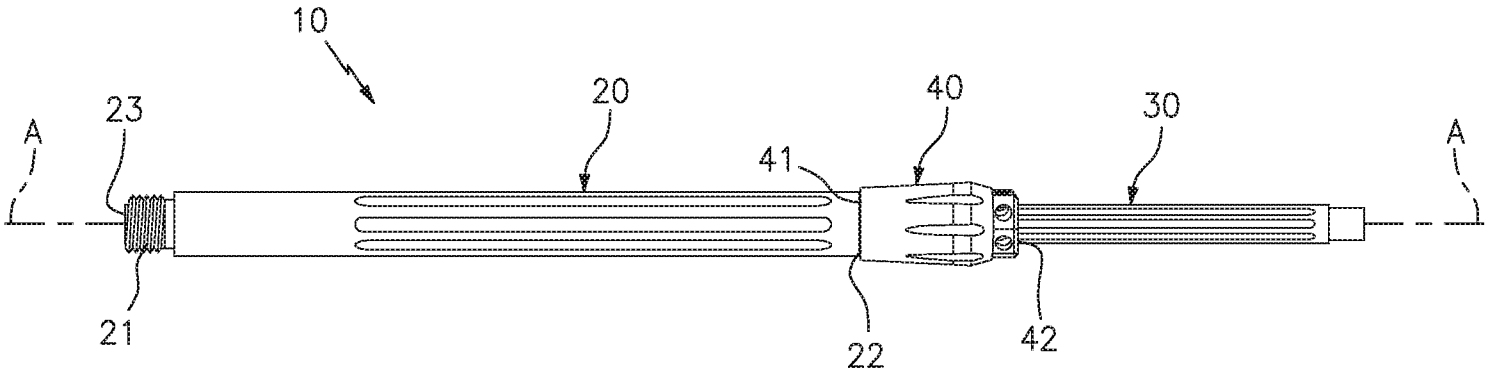
FIG. 5B is a side view of a fully assembled barrel assembly, in accordance with one embodiment of the invention.

As shown at FIGS. 5A and 5B, the first end 31 of the rifle barrel 30 can be positioned within the second end 22 of the sleeve 20 and slid lengthwise until the first end 34*a* of the positioning ring makes contact with the chamfered edge 25. Next, the locking nut 40 can be disposed about the end of the barrel 30 and slid lengthwise until the threads 44 engage the complementary threads 26 on the sleeve 20. As the threads are tightened, the barrel will be secured within the sleeve concentrically, and the angled edges 43*a* and 34*c* ensure a uniform longitudinal center line A.

Figure 5C:
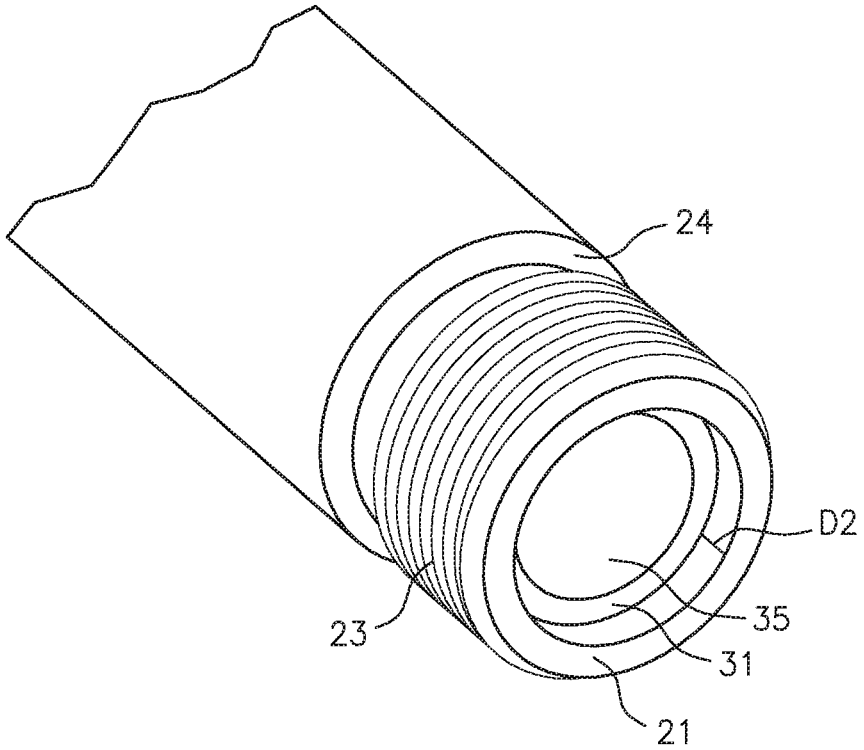
FIG. 5C is a perspective cutout view of the first end of a fully assembled barrel assembly, in accordance with one embodiment of the invention.
Figure 5D:
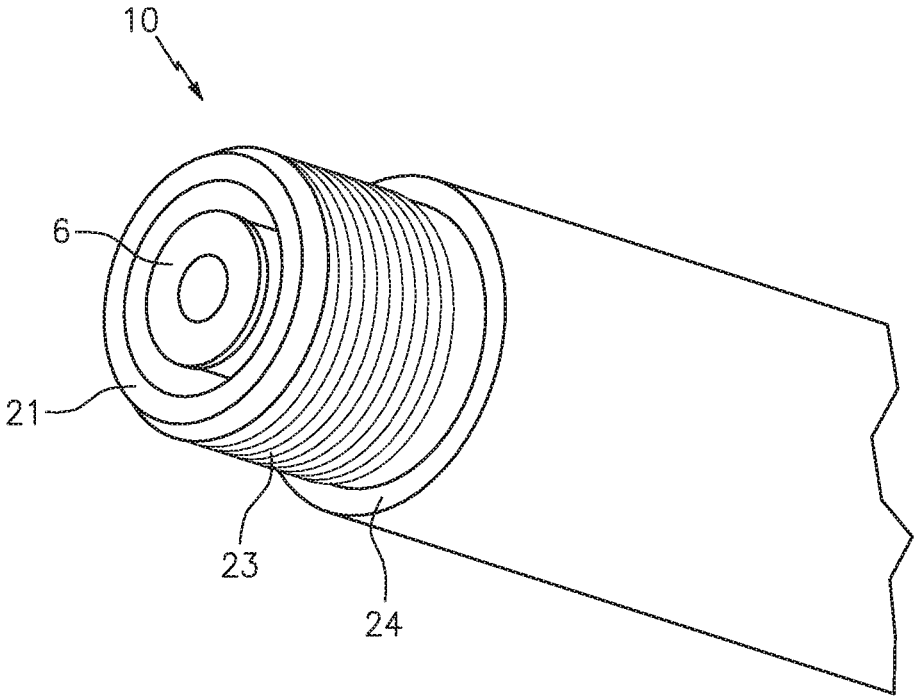
FIG. 5D is another perspective cutout view of the first end of a fully assembled barrel assembly, in accordance with one embodiment of the invention.

As noted above, the positioning ring 34 is positioned a specific distance D1 that is complementary to the length of the outer sleeve 20 minus the length of the rim of the cartridge to be fired. As shown in FIGS. 5C and 5D, when the barrel 30 is secured within the sleeve 20 as described above, the smooth first end of the barrel 31 will be separated from the first end of the sleeve 21 by a second distance D2. The second distance being equal to the length of the rim 6 of the firearm cartridge 7 for which the chamber 35 is sized to receive. Such a feature ensures proper head spacing for reliable firing of the assembled weapon.

Of course, other embodiments are contemplated wherein the positioning ring is located so as to align the first end of the barrel 31 to be flush with the first end of the sleeve and/or at any number of other relative positions so as to provide proper head spacing for the type/caliber of weapon and cartridge to be used.

In either instance, because the barrel is secured to the sleeve along the distal ends 32 and 22, as opposed to being directly secured to the receiver, the assembly 10 advantageously eliminates the above described issues regarding head spacing caused from by repeated attachment and removal of a barrel directly to the receiver.

In one embodiment, the sheath 20 can include a protrusion 28 (See FIG. 2B) and the barrel 30 can include a notch 34*d* (See FIG. 3D). During assembly, the protrusion is aligned with the notch, and secured therein by the tightening nut 40, as described above. Such a feature acts to prevent the barrel 30 from rotating within the sleeve upon receiving the rotational torque caused by a projectile passing through the rifling when being fired.

Additionally, the protrusion and notch function to ensure the barrel 30 is positioned within the sheath 20 in a manner wherein the lands (e.g., raised portion) of the fluting 33 are parallel with the grooves (e.g., recessed portion) of the fluting 27 and vice versa. By preventing a situation where the grooves of the fluting 27 and 33 are in a parallel orientation, the assembly maintains the factory-specified minimum material thickness for a light barrel, while providing the benefits and superior vibration absorption of a heavy barrel for each caliber cartridge to be used with the system.

As described herein, one or more elements of the barrel assembly 10 can be secured together utilizing any number of known attachments means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A barrel assembly for a rifle having a receiver, said assembly comprising:

an elongated hollow cylindrical-shaped sleeve having a first end, a second end, an inside diameter and an outside diameter;

a first plurality of threads that are positioned along the first end of the sleeve, said first plurality of threads including a shape and size that are complementary to a shape and size of a threaded end of a firearm receiver;

a rifle barrel having a first end, a second end, and an outside diameter, said outside diameter being less than the inside diameter of the sleeve;

a positioning ring that is positioned along an outside surface of the rifle barrel; and a locking nut, wherein the first end of the rifle barrel is configured to be positioned concentrically within the sleeve, and the locking nut is configured to lock the barrel within the sleeve, wherein the positioning ring includes an angled first end, a middle section having an outside diameter, and an angled second end, and wherein the second end of the sleeve includes a chamfered inner edge having an angle that is complementary to the angled first end of the positioning ring.

2. The assembly of claim 1, wherein the rifle barrel includes a chamber that is configured to receive a firearm cartridge.

3. The assembly of claim 2, wherein the chamber includes a length and a diameter that is complementary to a length and a diameter of the firearm cartridge.

4. The assembly of claim 2, wherein the positioning ring is located a first distance from the first end of the rifle barrel, said first distance being complementary to a length of the sleeve minus a length of a rim of the firearm cartridge.

5. The assembly of claim 2, wherein the firearm cartridge includes at least one of a .223 rifle cartridge or a .308 rifle cartridge.

6. The assembly of claim 1, further comprising:

a second plurality of threads that are positioned along the second end of the sleeve; and the locking nut including a threaded first end that is configured to engage the second plurality of threads.

7. The assembly of claim 1, wherein the second end of the sleeve includes a chamfered inner edge having an angle that is complementary to the angled first end of the positioning ring.

8. The assembly of claim 1, wherein the locking nut includes an internal shoulder having an angled edge that is complementary to the angled second end of the positioning ring.

9. A firearm comprising:

a receiver;

a trigger assembly;

a grip;

a sleeve that is in communication with the receiver, said sleeve including an elongated hollow cylindrical-shaped member having a first end, a second end, an inside diameter an outside diameter, and a first plurality of threads;

a rifle barrel having a first end that is removably positioned within the sleeve, and a second end that extends outward from the second end of the sleeve;

a positioning ring that is located along an outside surface of the rifle barrel, said positioning ring being in communication with the second end of the sleeve; and a locking nut that is in communication with each of the positioning ring and the second end of the sleeve, wherein the positioning ring includes an angled first end, a middle section having an outside diameter, and an angled second end, and the outside diameter of the middle section is complementary to a minor diameter of a second plurality of threads on the second end of the sleeve.

10. The assembly of claim 9, wherein the rifle barrel includes a chamber that is configured to receive a firearm cartridge.

11. The assembly of claim 10, wherein the chamber includes a length and a diameter that is complementary to a length and a diameter of the firearm cartridge.

12. The assembly of claim 10, wherein the positioning ring is located a first distance from the first end of the rifle barrel, said first distance being complementary to a length of the sleeve minus a length of a rim of the firearm cartridge.

13. The assembly of claim 10, wherein the firearm cartridge includes at least one of a .223 rifle cartridge or a .308 rifle cartridge.

14. The assembly of claim 9, wherein the locking nut is engaged to the second end of the sleeve via the first plurality of threads that are positioned along the second end of the sleeve and a first end of the locking nut.

15. The assembly of claim 9, wherein the second end of the sleeve includes a chamfered inner edge having an angle that is complementary to the angled first end of the positioning ring.

16. The assembly of claim 9, wherein the locking nut includes an internal shoulder having an angled edge that is complementary to the angled second end of the positioning ring.

* * * * *